US005954305A

United States Patent [19]

Calabro

[11] Patent Number: 5,954,305

[45] Date of Patent: Sep. 21, 1999

[54] ADAPTABLE ANTENNA MOUNTING PLATFORM FOR FIXED SECUREMENT TO AN ELONGATED MAST POLE

[75] Inventor: Francis C. Calabro, Pittston, Pa.

[73] Assignee: Summit Manufacturing, Inc., West Hazleton, Pa.

[21] Appl. No.: 08/929,207

[22] Filed: Sep. 9, 1997

[51] Int. Cl.[6] ..... A47B 96/06

[52] U.S. Cl. ..... 248/219.4; 248/230.1; 343/890

[58] Field of Search ..... 248/534, 539, 248/74.1, 228.6, 230.6, 231.71, 220.1, 231.21, 219.4, 74.4, 230.1; 343/878, 890, 892

[56] References Cited

U.S. PATENT DOCUMENTS

| | | | |
|---|---|---|---|
| 3,318,561 | 5/1967 | Finke et al. | 248/218.4 |
| 4,729,532 | 3/1988 | Moss | 248/74.1 |
| 5,029,799 | 7/1991 | Bernier | 248/514 |
| 5,097,647 | 3/1992 | Sopik et al. | 52/648 |
| 5,274,888 | 1/1994 | Payne | 24/277 |
| 5,467,955 | 11/1995 | Beyersmith | 248/219.3 |
| 5,533,304 | 7/1996 | Noble | 52/40 |
| 5,557,656 | 9/1996 | Ray et al. | 379/59 |
| 5,649,402 | 7/1997 | Moore | 52/651.02 |

*Primary Examiner*—Ramon O. Ramirez
*Assistant Examiner*—Gwendolyn Baxter
*Attorney, Agent, or Firm*—Caesar, Rivise, Bernstein, Cohen & Pokotilow, Ltd.

[57] ABSTRACT

An antenna mounting platform for mounting along the length of an elongated mast pole. The antenna mounting platform includes a frame assembly having a peripheral edge and an interior opening to enable access to the platform by service personnel. The frame assembly includes a walkway extending along the peripheral edge, the walkway having a width and an inner edge. The antenna mounting platform also comprises at least one antenna support arranged for supporting an antenna. The antenna support includes a bracket for slidably mounting the antenna support to the peripheral edge of the frame assembly for locating the antenna support at selectable positions along the peripheral edge of the frame.

20 Claims, 6 Drawing Sheets

FIG.1
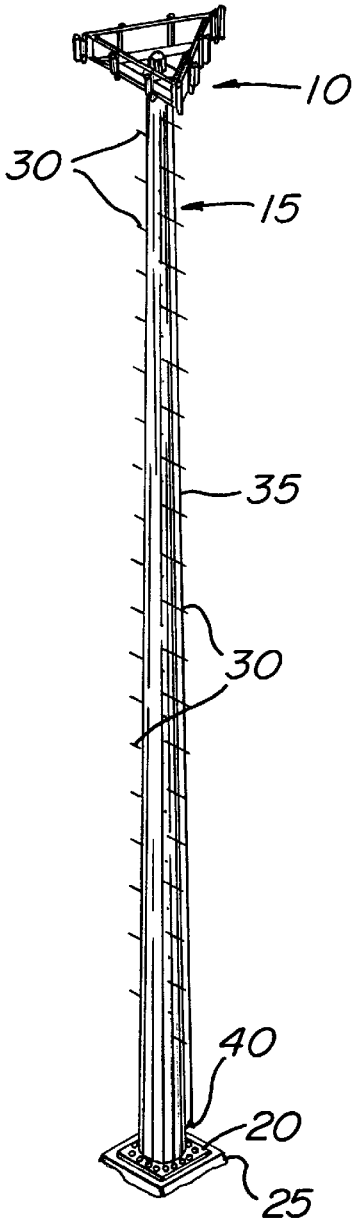
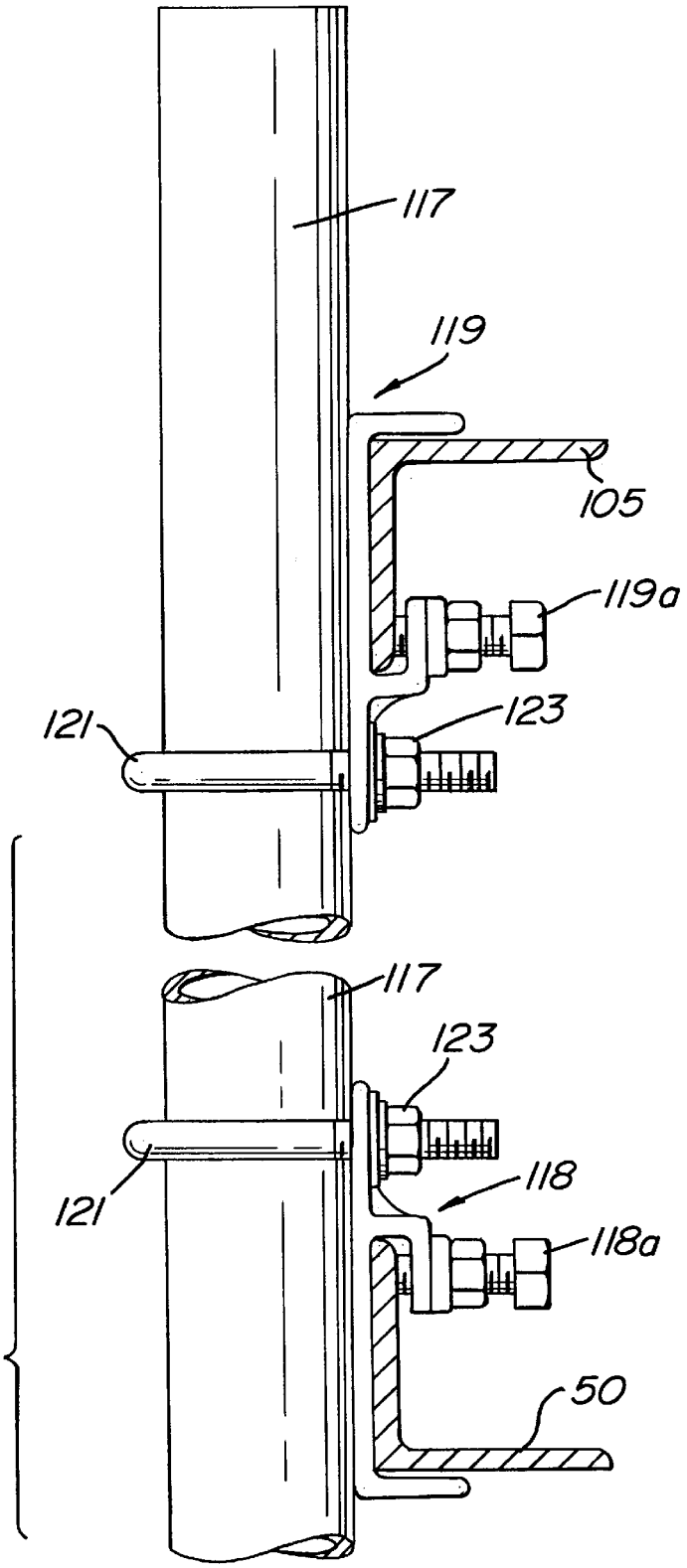
FIG.4

FIG. 2
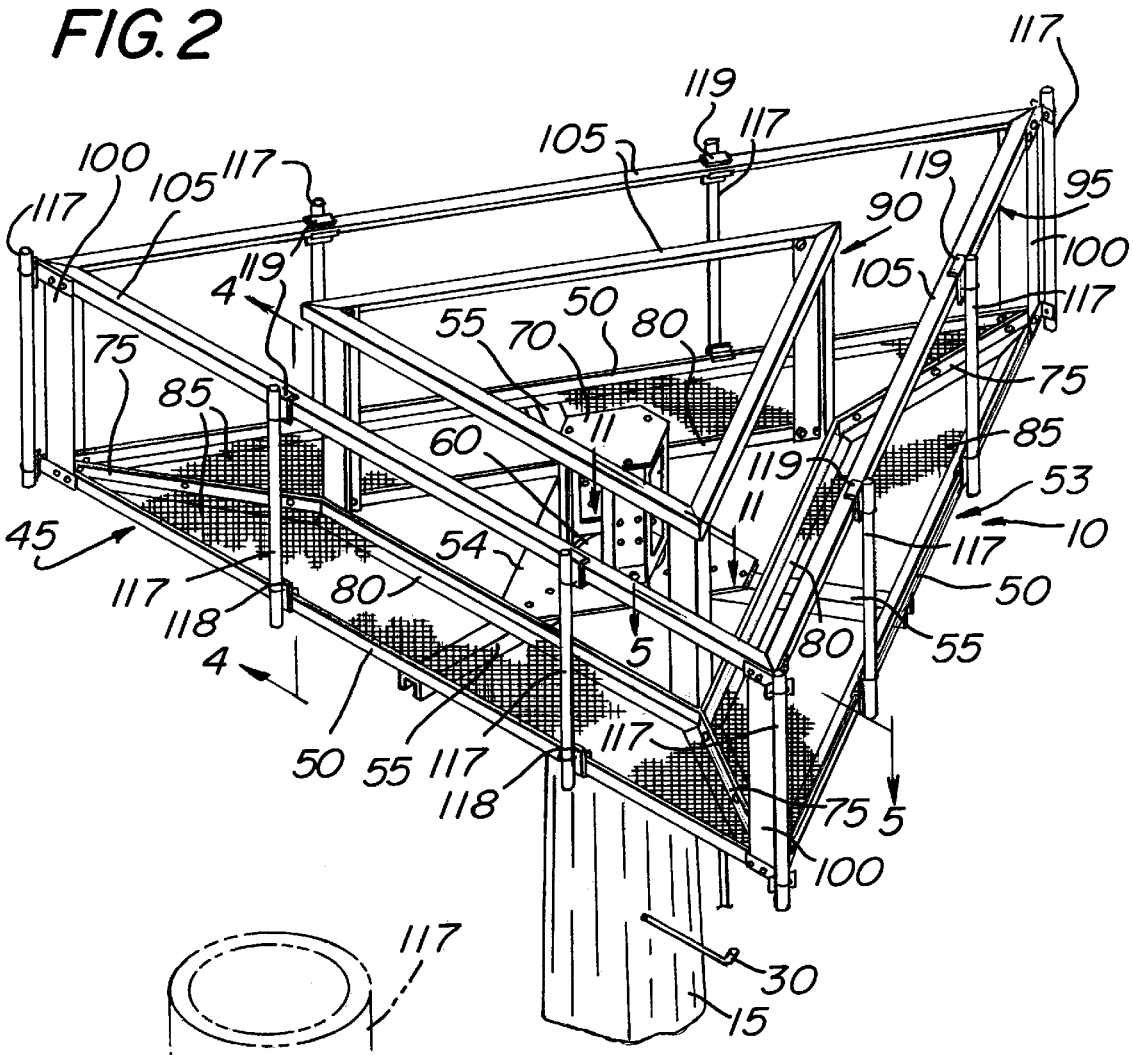
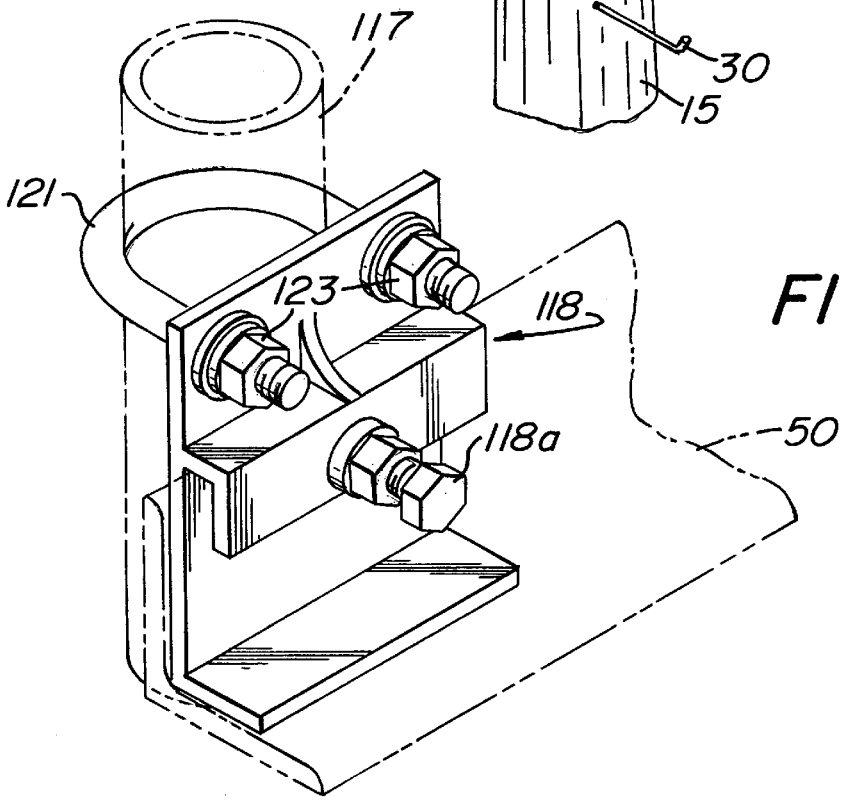
FIG. 3

ADAPTABLE ANTENNA MOUNTING PLATFORM FOR FIXED SECUREMENT TO AN ELONGATED MAST POLE

BACKGROUND OF THE INVENTION

This invention relates generally to antenna support platforms on elongated mast poles. More specifically, this invention relates to an adaptable antenna mounting platform for fixed securement to an elongated mast pole that allows for one or more antennae mounted thereon to be independently adjusted or tuned. This invention also relates to an adaptable antenna mounting platform that provides safety hand rails that are easily mounted to and removable from the platform by service personnel using conventional tools as may be required during installation, adjustment and removal of platform mounted antennae. Also, this invention relates to an antenna support platform that is adaptable to provide a low profile that is aesthetically pleasing and will not detract from the appearance of the location at which the communications pole is located.

Under the prior art, high mast platforms for mounting communications antennae are usually designed with safety hand rails mounted thereon based upon a customer's request or in accordance with industry safety standards. The safety hand rails provide a measure of safety to service personnel working on the platform in addition to their wearing safety harnesses tethered to the mast pole. Under the prior art, such safety hand rails are permanently affixed to the platform by means of welding. Often, these safety hand rails act to obstruct service personnel working on the platform during the installation, adjustment or removal of antennae thereon. For example, often it is necessary to maneuver one or several large or bulky pieces of telecommunications equipment on the platform which cannot fit between inner and outer safety rails. Often, the obstruction created by the safety hand rails may jeopardize the safety of personnel working on the platform. In such instances, service personnel may often find it necessary to remove one or more safety handrails, or portions thereof, from the platform in order to obtain the necessary space to conduct necessary service work on the platform. Under the prior art platforms, such safety hand rails are removed by cutting using appropriate welding equipment. Also, many in industry and the public have considered the presence of such permanently mounted safety hand rails to detract from the aesthetic appearance of the location on which the high mast pole is located. Therefore, it may also be desirable to remove the safety hand rails from the platform to provide a more streamlined and visually appealing appearance that would be less objectionable and more acceptable to the public and zoning review boards. Since relatively few welders possess the skills of a steeplejack trained to climb such high mast poles, such individuals are able to command a higher fee for their services in removing welded safety hand rails and are usually in great demand and often are unavailable. Therefore, detachment of the welded safety rails from the platform in this manner is often difficult, costly, time consuming and potentially damaging to the platform itself. Therefore, from both a cost and safety standpoint there has been a long-felt need by those in the public and those in the industry for a platform that eliminates the use of welded safety hand rails and that provides rails that may be easily mounted to and removed from the platform using conventional attachment hardware, e.g., nuts, bolts and washers, and tools, e.g., an adjustable wrench.

Also, under the prior art, platform mounted antennae are typically mounted to support structures that are welded directly to the platform. Often it becomes necessary for service personnel to adjust the position of these antennae in order to optimize the transmission or reception of signals. In order to make any adjustment to such platform mounted antennae, service personnel must cut the support structure on which the antenna is mounted from the platform using appropriate welding equipment, adjust the position of the antenna and reweld the support structure to the platform. This manner of adjusting platform mounted antennae is cumbersome. Moreover, where optimal signal transmission and reception are not initially achieved, it may be necessary to repeat the steps of cutting and rewelding the antenna support structures several times. Therefore, from a cost standpoint there has been a long-felt need by those in the public and those in the industry for a platform that eliminates the use of welded antenna support structures and that provides support structures that readily adjust to a variety of selectable locations to improve antenna performance.

OBJECTS OF THE INVENTION

It is a general object of this invention to provide an adaptable antenna mounting platform for fixed securement to an elongated mast pole which overcomes the disadvantages of the prior art.

It is another object of this invention to provide an adaptable antenna mounting platform for fixed securement to an elongated mast pole which provides an increased level of safety to service personnel.

It is another object of this invention to provide an adaptable antenna mounting platform for fixed securement to an elongated mast pole which reduces manpower requirements.

It is another object of this invention to provide an adaptable antenna mounting platform for fixed securement to an elongated mast pole which minimizes service costs.

It is another object of this invention to provide an adaptable antenna mounting platform for fixed securement to an elongated mast pole which reduces time spent adjusting antennae mounted thereon to obtain optimal signal transmission or reception.

It is another object of this invention to provide an adaptable antenna mounting platform for fixed securement to an elongated mast pole which provides a low profile which is visually appealing and therefore more acceptable to the public and zoning review boards.

It is another object of this invention to provide an adaptable antenna mounting platform for fixed securement to an elongated mast pole which does not detract from the aesthetic appearance of the surroundings in which it is located.

It is another object of this invention to provide an adaptable antenna mounting platform for fixed securement to an elongated mast pole which facilitates increasing the performance characteristics of antennae mounted thereon.

It is another object of this invention to provide an adaptable antenna mounting platform for fixed securement to an elongated mast pole which is simple and economical to manufacture.

It is another object of this invention to provide an adaptable antenna mounting platform for fixed securement to an elongated mast pole which allows one or more antenna supporting structures to be independently adjustable to a variety of selectable locations to improve antenna performance.

It is another object of this invention to provide an adaptable antenna mounting platform for fixed securement to an elongated mast pole which is inexpensive to manufacture.

It is another object of this, invention to provide an adaptable antenna mounting platform for fixed securement to an elongated mast pole which is reliable in operation.

It is another object of this invention to provide an adaptable antenna mounting platform for fixed securement to an elongated mast pole which facilitates installation of antennae thereon or removal of antennae therefrom.

It is another object of this invention to provide an adaptable antenna mounting platform for fixed securement to an elongated mast pole wherein adjustments made in the field are facilitated.

It is another object of this invention to provide an adaptable antenna mounting platform for fixed securement to an elongated mast pole which facilitates field conversion of the platform from a low profile to a standard profile and, conversely, from a standard profile to low profile.

SUMMARY OF THE INVENTION

These and other objects of this invention are achieved by providing an antenna mounting platform for mounting along the length of an elongated mast pole. The antenna mounting platform comprises a frame assembly having a peripheral edge and an interior opening to enable access to the platform by service personnel. The frame assembly includes a walkway extending along the peripheral edge, the walkway having a width and an inner edge. The antenna mounting platform also comprises at least one antenna support means arranged for supporting an antenna. The antenna support means includes a clamping means for slidably mounting the antenna support means to the peripheral edge of the frame assembly for locating the antenna support means at selectable positions along the peripheral edge of the frame.

DESCRIPTION OF THE DRAWINGS

FIG. 1 is an isometric view of the preferred embodiment of the present invention with only outer safety hand rails installed;

FIG. 2 is an isometric view of the preferred embodiment of the present invention with both the outer and inner safety hand rails installed;

FIG. 3 is a partial isometric view of a mounting bracket with associated hardware constructed in accordance with the present invention;

FIG. 4 is an enlarged sectional view taken along line 4—4 of FIG. 2; FIG.

DETAILED DESCRIPTION OF THE PREFERRED EMBODIMENTS

Figure 5:
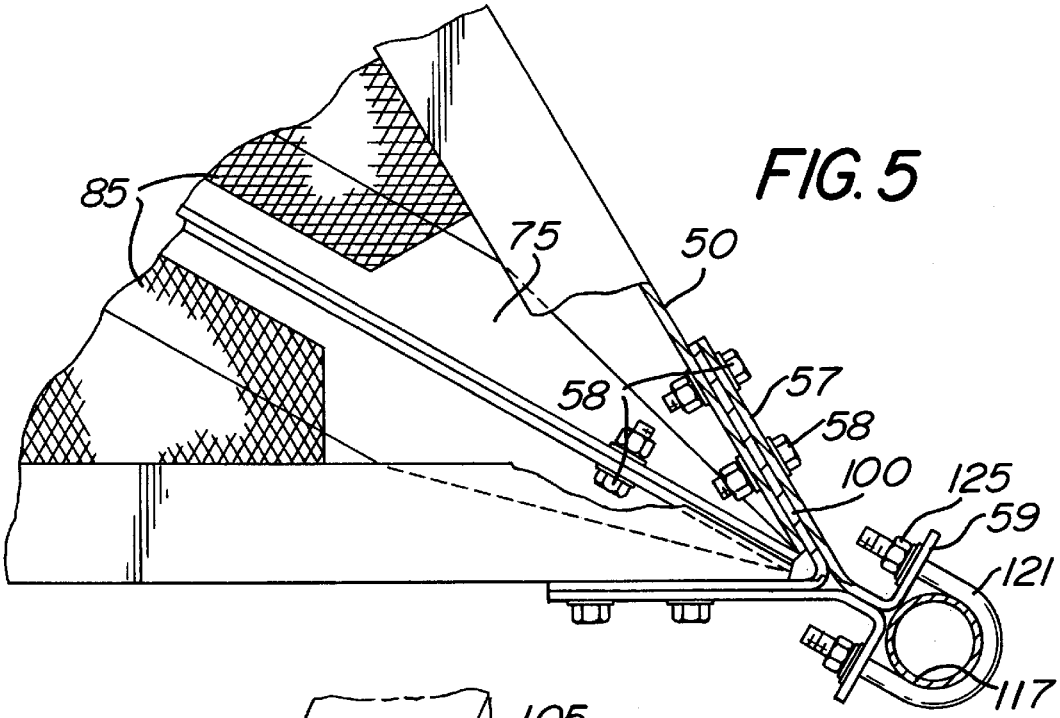
FIG. 5 is a enlarged sectional view taken along line 5—5 of FIG. 2.

Referring now to various figures of the drawings where like reference numerals refer to like parts, there is shown at 10 in FIG. 1, the preferred embodiment of the adaptable antenna mounting platform constructed in accordance with this invention. Although the platform 10 is shown in FIG. 1 as being fixedly secured at the top of an elongated mast pole 15, it should be understood that in accordance with the broadest aspect of this invention, the platform 10 could be located anywhere along the length of the mast pole 15. The mast pole 15 is a hollow member open at both ends and is provided with a horizontally disposed base flange 20 and a horizontally disposed top flange (not shown) welded thereto. The base flange 20 is provided with through openings to facilitate attachment of the mast pole 15 to a concrete pad 25 by any conventional means known to those practiced in the art, e.g., attachment to bolts extending upwardly from the concrete pad 25.

Positioned along the length of the mast pole 15 is a plurality of steps 30 to enable service personnel to climb upwardly from ground level and obtain access to the platform 10 for the installation, removal and adjustment of antennae. The steps 30 are attached to the outside surface of the mast pole 15 by any conventional means known to those practiced in the art, e.g., bolting or welding. A safety cable 35 extends the entire length of the mast pole 15 and is secured at its ends to the mast pole 15 by connection to flanges 40 disposed on the outer surface thereof at the top and bottom. Safety regulations usually require service personnel climbing the mast pole or working on the platform 10 to wear a safety harness connected to a safety cable such as the one shown at 35 by means of a lanyard for the purpose of protecting against a fall from an elevated position on the mast pole where that person may have slipped. The use of such a safety harness in combination with a safety cable is well known to those practiced in the art.

Referring now to FIG. 2, the platform 10 is shown mounted atop the mast pole 15. The platform 10 of the preferred embodiment comprises a support frame 45 comprising a plurality of angle-iron pieces 50 and 75 that are oriented and joined end-to-end to form an outer triangle having three corner regions and a peripheral edge 53. Angle-iron pieces 80 are joined together end-to-end and to angle-iron pieces 75 to form an inner triangle. The inner triangle surrounds a plurality of openings through which service personnel may climb to obtain access to the platform 10. FIG. 5 best illustrates the manner in which angle-iron pieces 50 and 75 are joined and held together in each of the corner regions of the support frame 45. In particular, a vertical support member 100 is disposed on the outside surface of the angle-iron pieces 50 and an angle bracket 57 is disposed over the outside surface of the vertical support member 100, all being secured together using conventional hardware 58, e.g., nuts, bolts and washers. Angleiron pieces 75 are also shown in FIG. 5 as being held together with conventional hardware 58. It is important to mention at this juncture that the shape of the platform 10 shown in FIG. 2 is merely exemplary and the platform 10 does not necessarily have to be triangular in shape. Referring back to FIG. 2, a plurality of elongated sheets 85 formed of metal grading lie over the angle-iron pieces 50, 75 and 80 to form a deck. The deck provides a walkway surface on which service personnel may work during mounting, adjustment or removal of platform mounted antennae.

Figure 7:
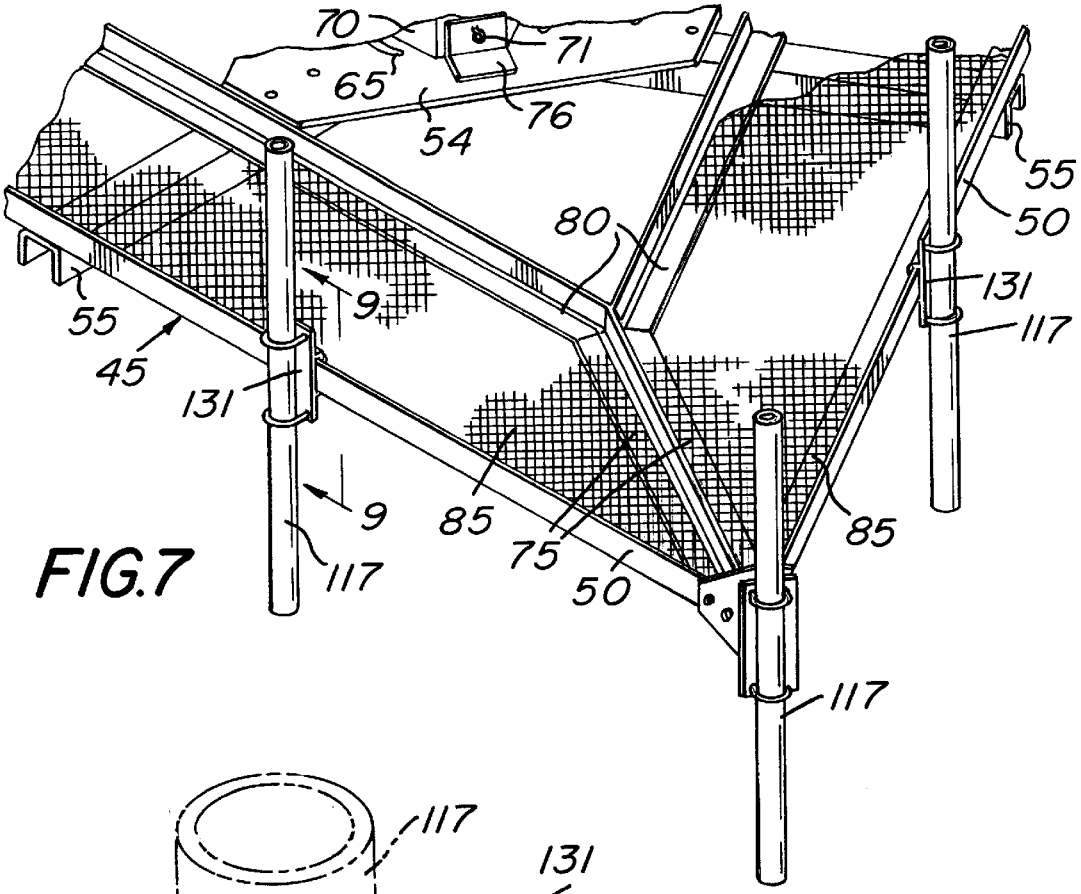
FIG. 7 is a partial isometric view of the preferred embodiment of the present invention with no safety hand rails attached.

The platform 10 additionally comprises a mounting plate 54 that is generally triangular in shape and may be fabricated from a galvanized metal, such as sheet steel or other suitable material. As best shown in FIG. 2, the mounting plate 54 is provided with a centrally located opening 60 through which cables (not shown), connected to platform mounted antennae (not shown), pass for connection with telecommunications equipment (not shown) normally positioned at ground level. As best shown in FIG. 7, the mounting plate 54 is also provided with a plurality of slotted through openings 65, to enable attachment of the platform 10 to horizontally disposed flanges (not shown) welded at the top of the mast pole 15 by any conventional means, e.g., nuts, bolts and washers. The through openings 65 in the mounting plate 54 are slotted to enable rotation of the platform 10 in order to achieve precise spatial orientation of the antennae mounted thereon so as to obtain optimal transmission and reception of signals.

Referring again to FIGS. 2 and 7, the mounting plate 54 is joined to the platform 10 by channel segments 55 formed of any suitable material, e.g., iron. At one end, each channel segment 55 is joined to the mounting plate 54 by any conventional means known to those practiced in the art, e.g., nuts, bolts and washers. At the other end, each channel segment 55 is affixed to an angle-iron piece 50 about midway along the length thereof also by conventional means known to those practiced in the art. As best shown in FIG. 7, a chimney 70 is secured to the top surface of the mounting plate 54 by means of L-shaped flanges 76 welded to the plate. The chimney 70 protects the interior of the mast pole from weather elements such as rain and snow. Also, the chimney 70 is provided with an eyebolt 71 attached thereto. Once service personnel have climbed onto the platform 10, they may connect their safety harnesses to the eyebolt 71 as a means for fall prevention.

Figure 6:
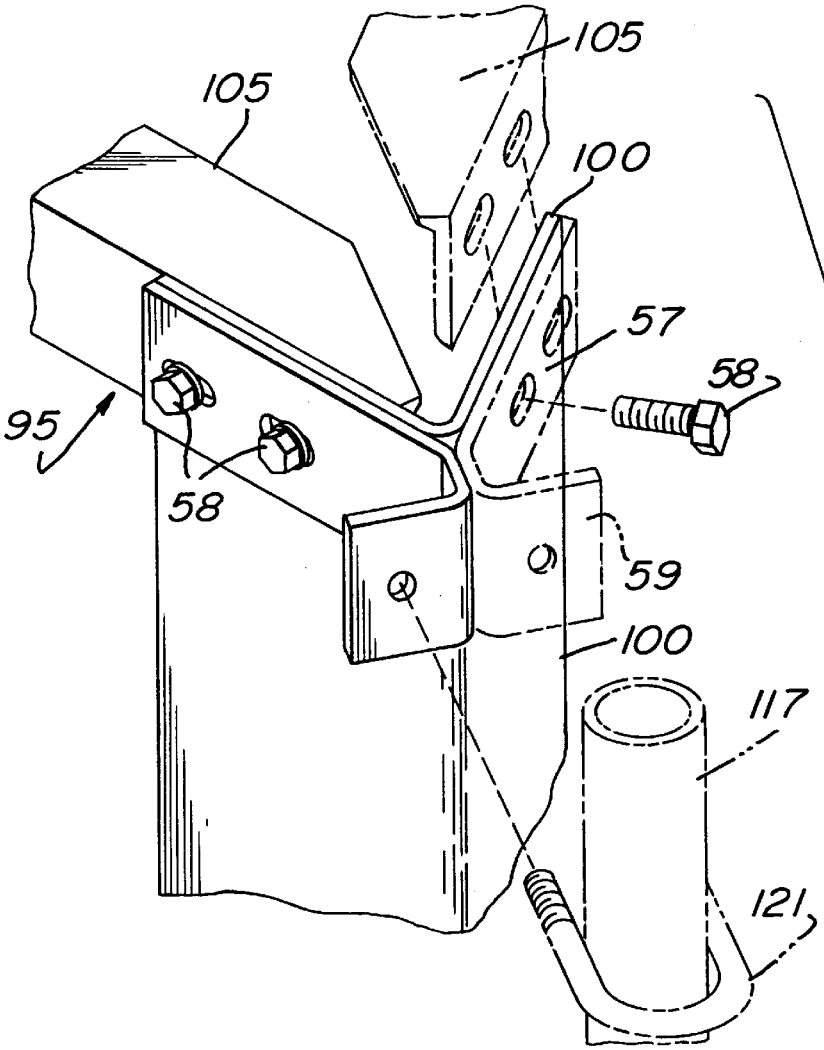
FIG. 6 is a partial isometric view of a mounting bracket with associated mounting hardware constructed in accordance with the present invention.

Referring now to FIG. 2, the adaptable antenna mounting platform 10 is shown therein as having an inner safety hand rail assembly 90 and an outer safety hand rail assembly 95 mounted thereon. Referring now to FIG. 6, the outer hand rail assembly 95 comprises a plurality of cross-members 105 formed of angle-iron pieces that are secured together end-to-end by attachment to upright support members 100 and angle brackets 57 using conventional hardware 58, e.g., nuts, bolts and washers. The cross-members 105 are shown in FIG. 2 as forming a triangular shape, however, it should be understood that this shape is merely exemplary. The inner safety hand rail assembly 90 is assembled to the platform using angle brackets in a similar manner.

Referring now to FIGS. 2, 3 and 4, antenna support tubes 117 mount to the platform 10 by means of adjustable brackets 118 and 119; the adjustable bracket 118 mounting the support tube 117 to a cross-member 105 and the adjustable bracket 119 mounting the support tube 117 to an angle-iron piece 50. As best shown in FIGS. 3 and 4, the adjustable bracket 118 is shaped to fit over the angle-iron piece 50 and the adjustable bracket 119 is shaped to fit over cross-member 105. By tightening on bolt 118*a*, the bracket 118 may be fixedly secured to the angle-iron 50. Similarly, by tightening on bolt 119*a*, the bracket 119 may be fixedly secured to the cross-member 105. By slightly loosening bolts 118*a* and 119*a*, using a conventional adjustable wrench, the brackets 118 and 119 may be simultaneously slid to selectable positions along angle-iron 50 and cross-member 105, respectively, to enable adjustment of the position of the antenna support tube 117 and antennae mounted thereon. The antenna support tubes 117 are held to brackets 118 and 119 by means of threaded U-bolts 121 and associated conventional hardware 123, e.g., nuts and washers, thus facilitating installation and removal of antenna support tubes 117 to and from brackets 118 and 119.

Figure 11:
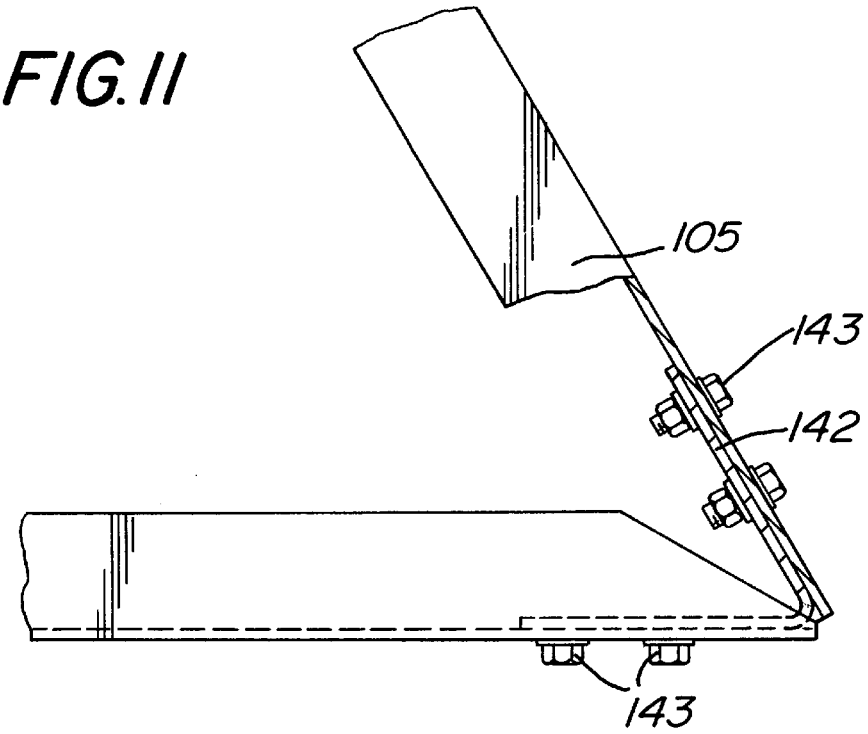
FIG. 11 is an sectional view taken along line-11—11 of FIG. 2.
Figure 12:
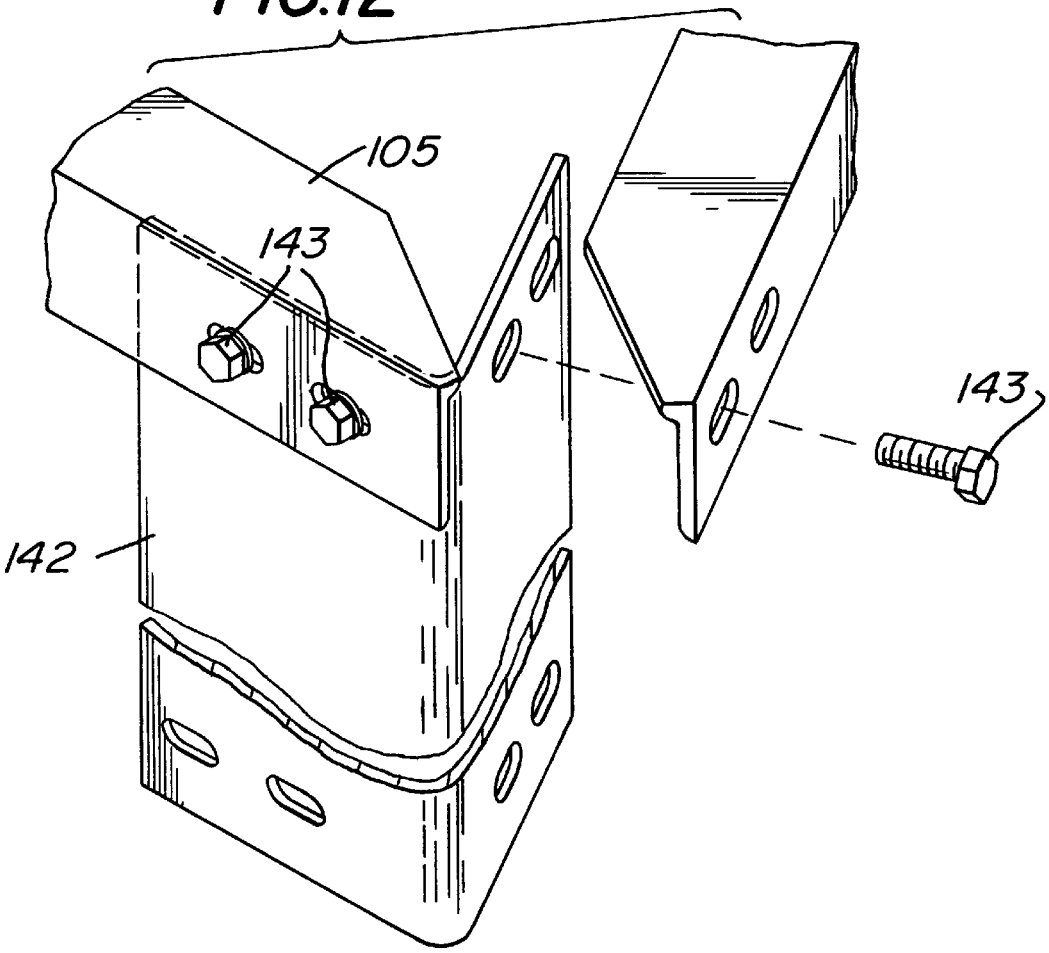
FIG. 12 is a partial exploded isometric view of a corner bracket with associated mounting hardware constructed in accordance with the present invention.

Referring again to FIGS. 2, 5 and 6, antenna support tubes 117 may be mounted in each corner region of the platform 10. As best shown in FIGS. 5 and 6, the corner brackets 57 further comprise a mounting plate 59 which is arranged for attachment of the antenna support tubes 117 thereto using conventional attachment hardware, e.g., threaded U-bolts 121, nuts 125 and washers. Alternatively, it may not be desirable to mount antenna support tubes at the corner regions of the platform 10. Referring now to FIGS. 11 and 12, there is shown therein an angular upright member 142 for joining cross-members 105 end-to-end using conventional hardware 143, e.g., nuts, bolts and washers. The angular upright member 142 shown in FIGS. 11 and 12 does not provide a means for supporting antenna support tubes thereon.

At this juncture, it is important to mention that with both safety hand rail assemblies 90 and 95 in place as shown in FIG. 2, the platform 10 is said to have a standard profile. Provision of both the safety hand rail assemblies 90 and 95 on the platform 10 serves to improve the safety of service personnel working on the platform 10 at heights exceeding one-hundred fifty feet. However, as previously discussed, in certain circumstances, one or both of the safety hand rails may act as an obstruction to service personnel working on the platform 10. For example, in these circumstances it may be desirable to remove the inner safety hand rail or a portion thereof to facilitate the maneuvering of equipment and conducting other service activities on the platform 10 during installation, adjustment or removal of platform mounted antennae. To eliminate the obstruction, the inner safety hand rail assembly 90 or a portion thereof may be easily removed from the platform 10 by use of an adjustable wrench. In FIG. 1, the platform 10 of the present invention is shown with the inner safety hand rail 90 removed and the outer safety hand rail remaining in place.

Figure 8:
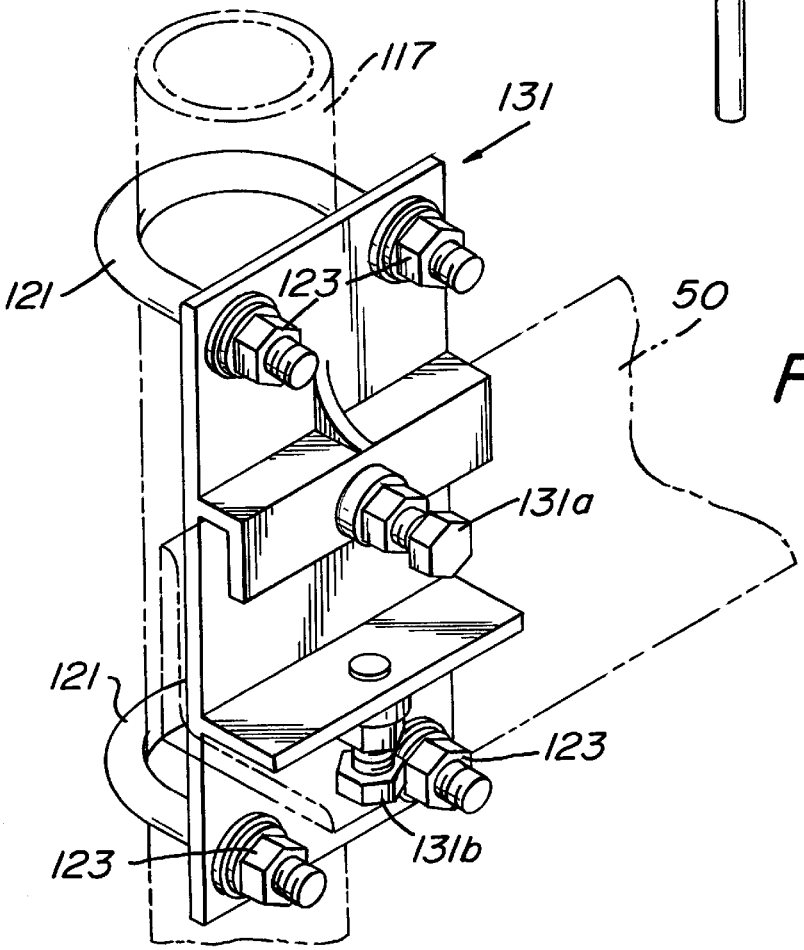
FIG. 8 is a partial isometric view of a mounting bracket with associated mounting hardware constructed in accordance with the present invention.
Figure 9:
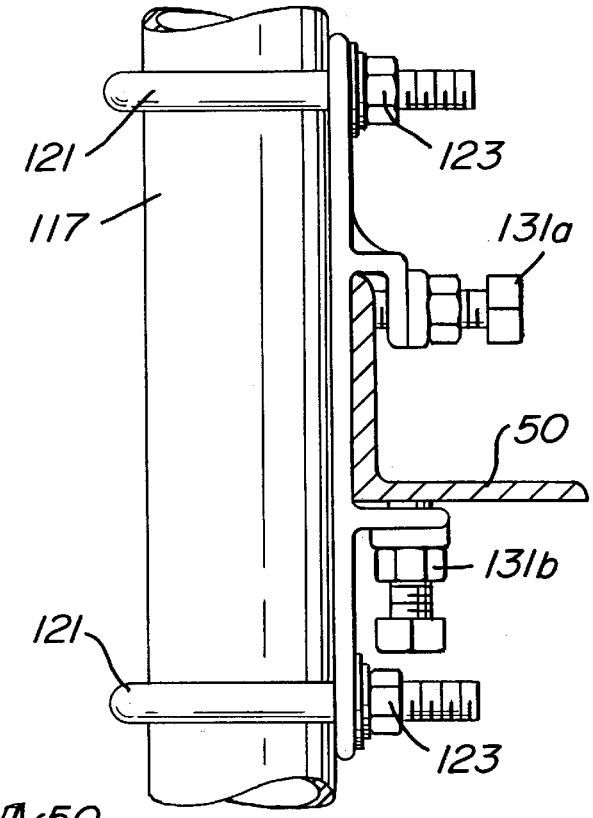
FIG. 9 is an enlarged sectional view taken along line 9—9 of FIG. 7.

Further, it may be desirable to remove both safety hand rails 90 and 95 from the platform where the rails may be considered to be aesthetically unappealing and detracting from the appearance of the location at which the communications pole is located. Referring now to FIG. 7, the platform 10 is shown therein as having both the inside and outside safety hand rails removed. When in this configuration, the platform is said to have a low profile. Referring now to FIGS. 8 and 9, when it is desirable to utilize this low profile configuration, adjustable brackets 131 may be utilized for mounting of antenna support tubes 117. The adjustable brackets 131 are shaped to fit over angle-iron piece 50. By tightening on associated hardware 131*a*, e.g., nut and bolt, the bracket 131 may be fixedly secured to the angle-iron 50. By slightly loosening the associated hardware 131*a* using a conventional adjustable wrench, the bracket 131 may be slid to selectable positions along angle-iron 50 to enable adjustment of the position of the antenna support tube 117 and antennae (not shown) mounted thereon. The antenna support tube 117 is held to the bracket 131 by means of a pair of threaded U-bolts 121 and associated conventional hardware 123, e.g., nuts and washers, thus facilitating installation and removal of antenna support tubes 117 to and from the bracket 131 without the necessity to remove the bracket 131 from the angle-iron 50.

Figure 10:
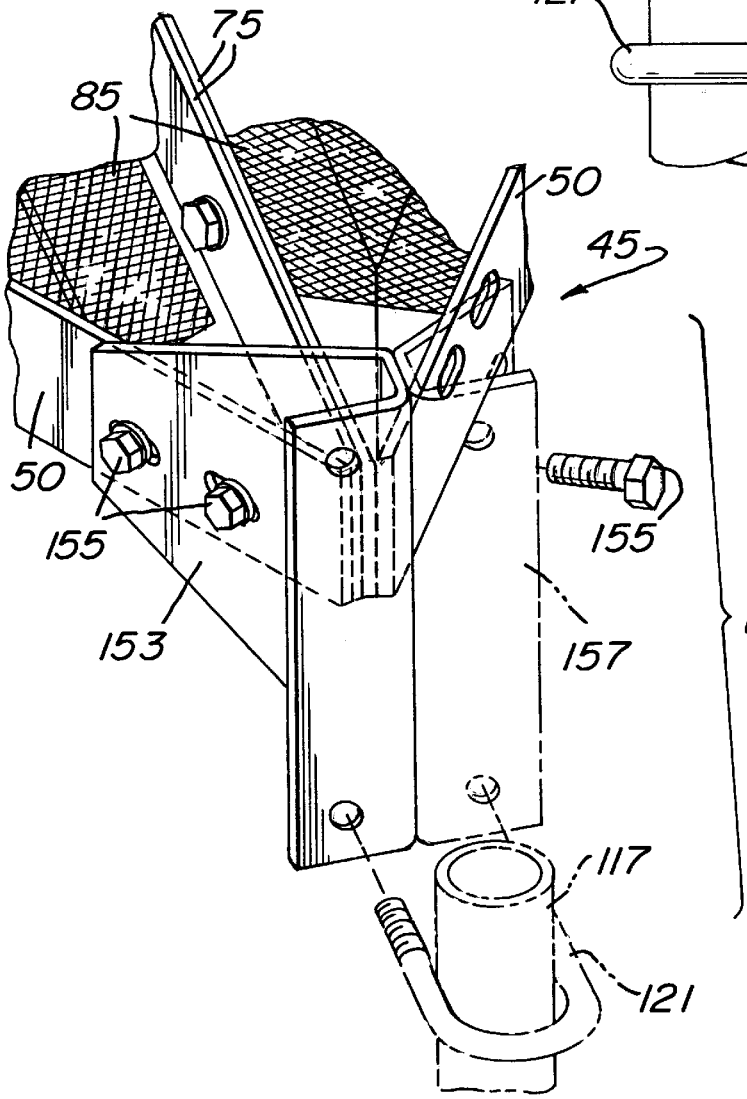
FIG. 10 is a partial exploded isometric view of a corner mounting bracket with associated mounting hardware constructed in accordance with the present invention.

Referring now to FIG. 10, when the platform assembly of the present invention is utilized in the low profile configuration, the angle-iron pieces 50 and 75 may be joined together in each of the corner regions of the frame 45 using an angle bracket 153 and conventional hardware 155, e.g., nuts, bolts and washers. The angle bracket 153 further comprises a mounting plate 157 having through holes which is arranged for attachment of the antenna support tubes 117 thereon by use of threaded U-bolts 121, nuts and washers 123. Although the mounting plate 157 is shown in FIG. 10 as having rounded through holes for mounting, these mounting holes could also be horizontally slotted to enable horizontal adjustment of the U-bolts 121 and antenna support tubes 117 mounted thereon.

At this point it bears repeating that the shapes and sizes of the various components described herein are shown for the purpose of example only and other shapes and/or sizes could be utilized without departing from the spirit of this invention.

What I claim is:

1. An antenna mounting platform for mounting alone the length of an elongated mast pole, said antenna mounting platform comprising:

a. a frame assembly comprising a peripheral edge formed of an angular member and an interior opening to enable access by service personnel thereon, said frame assembly additionally comprising a walkway extending along said peripheral edge, said walkway having a width and an inner edge; and, b. at least one antenna support assembly arranged for supporting an antenna, said antenna support assembly comprising a bracket arranged to fit over said angular member and at least one bolt threaded into said bracket and extending therethrough to retain said bracket in a set position against said angular member when said at least one bolt is rotated so that said at least one bolt presses said angular member against said bracket, said bracket and said at least one bolt also provided for slidably mounting said antenna support assembly to said angular member for locating said antenna support assembly at selectable positions therealong, said antenna support assembly being removably mountable to said angular member.

2. The antenna mounting platform of claim 1 wherein said angular member is formed of angle iron.

3. The antenna mounting platform of claim 1 wherein said at least one bolt comprises two bolts.

4. The antenna mounting platform of claim 1 wherein said frame assembly is substantially triangular in shape and having three corner regions.

5. The antenna mounting platform of claim 4 wherein said triangular shape of said frame assembly is equilateral.

6. The antenna mounting platform of claim 1 wherein said walkway comprises a flat sheet of metal grading.

7. The antenna mounting platform of claim 1 wherein said antenna support assembly additionally comprises an elongate pipe secured to a mounting plate by means of at least one U-bolt surrounding said pipe and having threaded ends extending through said mounting plate, said antenna support means additionally comprising a nut threaded onto each threaded end of said at least one U-bolt, said nut being rotated so that said at least one U-bolt presses said elongate pipe against said mounting plate.

8. The antenna mounting platform of claim 7 wherein said at least one U-bolt comprises two spaced apart U-bolts.

9. The antenna mounting platform of claim 7 wherein said mounting plate is integral with said bracket.

10. The antenna mounting platform of claim 5 additionally comprising an outer safety hand rail assembly, said outer safety hand rail assembly comprising at least two vertical support members, each vertical support member being removably secured to the peripheral edge of said frame assembly and extending upwardly therefrom to a free end, said outer safety hand rail assembly further comprising at least one cross member extending horizontally between said vertical support members and being removably secured to the free ends thereof.

11. The antenna mounting platform of claim 10 wherein each of said vertical support members of said outer safety hand rail assembly additionally comprises an antenna support assembly mounted thereon.

12. The antenna mounting platform of claim 11 wherein said frame assembly is substantially triangular in shape and having three corner regions.

13. The antenna assembly mounting platform of claim 12 wherein said triangular shape of said frame assembly is equilateral.

14. The antenna mounting platform of claim 13 wherein said vertical support members are three in number, each vertical support member being located in a corner region of said frame assembly, and wherein said at least one cross member is three in number and forming a triangular shape that is equilateral.

15. The antenna mounting platform of claim 14 wherein said antenna support assembly further comprises a second bracket having at least one bolt threaded therein for slidably mounting said antenna support assembly to one of said cross members.

16. The antenna mounting platform of claim 15 wherein said cross members are formed of an angular member.

17. The antenna mounting platform of claim 13 additionally comprising an inner safety hand rail assembly, said inner safety hand rail assembly comprising at least two vertical support members, each support member being removably secured to the inner edge of said walkway and extending upwardly therefrom to a free end, said inner safety hand rail assembly further comprising at laest one cross member extending horizontally between said vertical support members and being removably secured to the free ends thereof.

18. The antenna mounting platform of claim 17 wherein said vertical support members of said inner safety hand rail assembly are three in number and wherein said at least one cross member of said inner safety hand rail is three in number and forming a triangular shape that is equilateral.

19. The antenna mounting platform of claim 1 wherein said platform is mounted at the top of the elongated mast pole.

20. The antenna mounting platform of claim 1 wherein said platform is mounted below the top of the elongated mast pole.

* * * * *